US009089954B2

(12) United States Patent
Roehm

(10) Patent No.: US 9,089,954 B2
(45) Date of Patent: Jul. 28, 2015

(54) HAND-HELD TOOL MACHINE HAVING A SWITCHABLE MECHANISM

(75) Inventor: Heiko Roehm, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1082 days.

(21) Appl. No.: 12/998,043

(22) PCT Filed: Aug. 12, 2009

(86) PCT No.: PCT/EP2009/060414

§ 371 (c)(1),
(2), (4) Date: Jun. 9, 2011

(87) PCT Pub. No.: WO2010/028924

PCT Pub. Date: Mar. 18, 2010

(65) Prior Publication Data

US 2011/0259620 A1 Oct. 27, 2011

(30) Foreign Application Priority Data

Sep. 12, 2008 (DE) ..... 10 2008 042 033

(51) Int. Cl.
*B25B 21/00* (2006.01)
*B25F 5/00* (2006.01)

(52) U.S. Cl.
CPC ..... *B25B 21/00* (2013.01); *B25F 5/001* (2013.01)

(58) Field of Classification Search
CPC ..... B25F 5/001; F16H 59/042; B25B 21/00
USPC ..... 173/47, 216, 217, 170, 171, 176, 48; 475/317, 298, 299; 267/258, 36.1, 160, 267/161
See application file for complete search history.

(56) References Cited

U.S. PATENT DOCUMENTS

| | | | | |
|---|---|---|---|---|
| 4,791,833 | A | 12/1988 | Sakai et al. | |
| 5,339,908 | A | 8/1994 | Yokota et al. | |
| 6,186,709 | B1 * | 2/2001 | Hsu | 408/241 R |
| 6,655,470 | B1 | 12/2003 | Chen | |
| 6,860,341 | B2 * | 3/2005 | Spielmann et al. | 173/216 |
| 8,074,735 | B2 * | 12/2011 | Aeberhard et al. | 173/216 |
| 2004/0020669 | A1 * | 2/2004 | Spielmann et al. | 173/178 |
| 2005/0215385 | A1 * | 9/2005 | Spielmann et al. | 475/298 |
| 2008/0098842 | A1 * | 5/2008 | Spielmann et al. | 74/473.1 |

FOREIGN PATENT DOCUMENTS

| | | |
|---|---|---|
| CN | 1419997 | 5/2003 |
| CN | 1817569 | 8/2006 |
| CN | 101090806 | 12/2007 |
| DE | 35 25 208 | 1/1986 |
| DE | 39 04 085 | 8/1990 |
| DE | 197 54 165 | 6/1999 |
| DE | 202 20 001 | 3/2003 |
| DE | 101 56 392 | 6/2003 |
| DE | 102 22 824 | 12/2003 |

(Continued)

*Primary Examiner* — Stephen F Gerrity
*Assistant Examiner* — Joy N Sanders
(74) *Attorney, Agent, or Firm* — Kenyon & Kenyon LLP

(57) ABSTRACT

A hand-held tool machine has a switchable mechanism having at least two operating positions, which are able to be selected via an adjustable operating element, the operating element being coupled to an adjustable switching element via a coupling element. The coupling element is implemented as bistable coupling spring.

23 Claims, 2 Drawing Sheets

(56) References Cited

FOREIGN PATENT DOCUMENTS

| | | |
|---|---|---|
| DE | 10 2004 011 617 | 9/2005 |
| DE | 10 2004 058 809 | 6/2006 |
| DE | 10 2006 035 386 | 5/2008 |
| JP | 62 166971 | 7/1987 |
| JP | 62-166981 | 7/1987 |
| JP | 05 073343 | 10/1993 |
| JP | 2585716 | 9/1998 |
| RU | 2 112 639 | 6/1998 |
| SU | 994244 | 2/1983 |

* cited by examiner

HAND-HELD TOOL MACHINE HAVING A SWITCHABLE MECHANISM

BACKGROUND OF THE INVENTION

1. Field of the Invention

The present invention relates to a hand-held tool machine having a switchable mechanism.

2. Description of Related Art

From published German patent application document DE 10 2004 058 809 A1, a battery-powered screwdriver is known, which has an electrical drive motor which drives a tool holder for accommodating a tool via a multi-stage planetary gear, the tool holder being rotatably supported in the housing.

Such battery-powered screwdrivers are frequently equipped with a switchable planetary gear, which is able to be switched between a first gear ratio having a slow rotational speed and high torque, and a second gear ratio step having a higher rotational speed and lower torque. The switchover is achieved with the aid of a gear shifter in the form of a slider on the outside of the housing, which can be manually adjusted in the axial direction, thereby causing the displacement of an internal gear wheel between two switching positions. The internal gear wheel acts on a gear wheel of the planetary gear, which is coupled to the housing in a first switching position, and coupled to a planetary-gear carrier of the planetary gear in a second switching position.

In this context it should be noted that the locking of the internal gear wheel when a switch takes place between the gear ratios may be more difficult, in particular under load, due to differences in the rotational speeds. For this reason spring elements may be provided, which in response to the corresponding actuation of the gear shifter apply force to the internal gear wheel in order to bring it into the desired switching position, so that the internal gear wheel locks into the desired switching position only after the drive motor has been switched off and the internal gear wheel has been switched on again. However, the force of the spring elements must be adapted to the force of a further spring element, with whose aid the gear shifter is securely retained in its particular switching positions in order to prevent unintentional resetting of the gear shifter. On the other hand, the spring force acting on the gear shifter must not be excessive either in order to ensure an ergonomic actuation of the gear shifter.

BRIEF SUMMARY OF THE INVENTION

The present invention provides a hand-held tool machine having a mechanism for switching between at least two operating positions using simple constructive measures, such that a switch between the operating positions is able to be implemented in a reliable and ergonomic manner with reduced component stressing, under different operating conditions, in particular also under load.

The hand-held tool machine according to the present invention is equipped with a switchable mechanism, which has at least two operating positions that may be selected via an operating element. Using a coupling element, the operating element is linked to an adjustable switching element, which acts upon at least one mechanical component of the switchable mechanism.

According to the present invention, the coupling element, which transmits the positioning movement of the operating element to the switching element supported in the mechanism's housing, is implemented as bistable coupling spring, which assumes a stable position in the two switching positions of the operating element, and an instable position in an intermediate position, through which the coupling spring passes in the transition between the switching positions.

A variety of advantages are derived from this development. The coupling spring has a dual function; for one, it transmits the motion to the switching element and for another, it applies the force for the move into the particular switch position, thus making it possible to dispense with one or more additional spring element(s) by which force is applied to the switching device to move it into the individual switching position. Over all, this achieves a simplification in terms of components and it reduces the number of components.

This simplification is achieved by uncomplicated measures, in particular when the coupling spring is developed as spring washer, which preferably is supported in a manner allowing pivoting about a transverse axis that runs at a right angle to the longitudinal motor axis of the hand-held tool machine. The bistability is preferably achieved, or at least aided, by prestressing the spring washer, which causes the spring washer to assume a stable position in the two swung-out positions, whereas the spring washer is unstable in an intermediate position. The unstable intermediate position facilitates the attainment of the particular other switching position, in which the spring washer reassumes its stable position.

The prestressing of the spring ring constitutes an easily manageable measure for keeping the spring element stable in the individual switching position. This also provides a high degree of safety against inadvertent resetting of the operating element to the particular other switching position for engaging a different operating position, while the hand-held tool machine is in operation.

According to one preferred development, the hand-held tool machine is equipped with a switchable gear having multiple gear ratios as a mechanism, the mechanism having at least two gear ratios, which are able to be selected via a gear shifter as operating element. With the aid of the coupling element, the gear shifter is coupled to the adjustable switching element, which acts upon at least one gear component of the switchable gear. If the gear is implemented as planetary gear, then it makes sense to implement the adjustable switching element as internal gear wheel, which is able to be axially adjusted in the gear housing between a housing-mounted stop position, and a stop position on the side of the gear; in the stop position on the housing side, an internal gear wheel on the housing side is locked, and in the stop position on the side of the gear, the internal gear wheel is fixedly coupled to a planetary-gear carrier of the planetary gear and rotates along with it.

The tiltability of the spring washer is preferably realized by premolding on the spring washer tilting elements, which are supported in corresponding recesses in the housing of the hand-held tool machine and define a tilting axis running at a right angle to the longitudinal axis of the hand-held tool machine. These tilting elements are preferably implemented in the form of tilting lips on the radially inner side of the spring washer, but an implementation on the radially outer side of the spring washer is basically conceivable as well. Furthermore, a reverse implementation is possible too, in which tilting projections are disposed on the housing and project into associated tilting recesses on the spring washer, which are situated either on the radially inner side or an the radially outer side of the spring washer.

For practical purposes, the contact between the spring washer and the gear shifter is made by an externally projecting driving pin on the spring washer, which the gear shifter is to actuate, preferably axially, parallel to the longitudinal axis of the hand-held tool machine, in both directions. Due to the tiltable support of the spring washer, the axial positioning movement of the gear shifter is converted into a rotary or tilting motion of the spring washer, which is coupled to the switching element which preferably is axially supported in the gear housing, similar to the gear shifter, and able to execute a positioning movement in the axial direction.

In this context it may be useful to implement the connection between the spring washer and the switching element via fingers on the spring washer, which are preferably formed integrally with the spring washer, just like the tilting elements and the driving pin. The implementation in the form of fingers which extend on the spring washer, especially radially toward the inside, offers the further advantage of achieving an additional spring effect via the fingers, which becomes effective between the spring washer and the switching element. This spring action may be used for preselecting a gear ratio, in particular in the event that a gear shift operation takes place while the hand-held tool machine is running, during which the switching element or a gear component related to the switching element is unable to be transferred into the desired engagement position due to differences in rotational speeds. In this manner, the desired gear ratio is preselectable via an adjustment of the gear shifter; due to the spring effect of the fingers on the spring washer, the switching element is adjusted in the direction of the desired switching position without damaging components, which switching position, however, is attained only after the drive motor has stopped or has been switched on again. Via the fingers on the spring washer, an additional spring action is therefore achieved, without the need to provide an additional component for this purpose.

The spring washer may be realized as semicircle or also as full circle. When implemented as semicircle, the tilting elements expediently lie between the fingers that establish the connection to the switching element, and the driving pin, which is actuated by the gear shifter. The fingers are preferably situated on the free end faces of the semicircular spring washer and radially protect to the inside.

When implemented as full circle, however, it is useful to place the tilting elements diametrically opposite the driving pin, the fingers being situated at a 90° offset relative to the tilting elements or the driving pin. In this implementation the axis of rotation lies adjacent to the inside of the spring washer, in the form of a tangent. Due to the prestressing, the spring washer having the shape of a full circle assumes a virtually conical form in its two switching positions.

For practical purposes, the coupling spring is realized as metal component, especially as sheet-metal component.

DETAILED DESCRIPTION OF THE INVENTION

Figure 1:
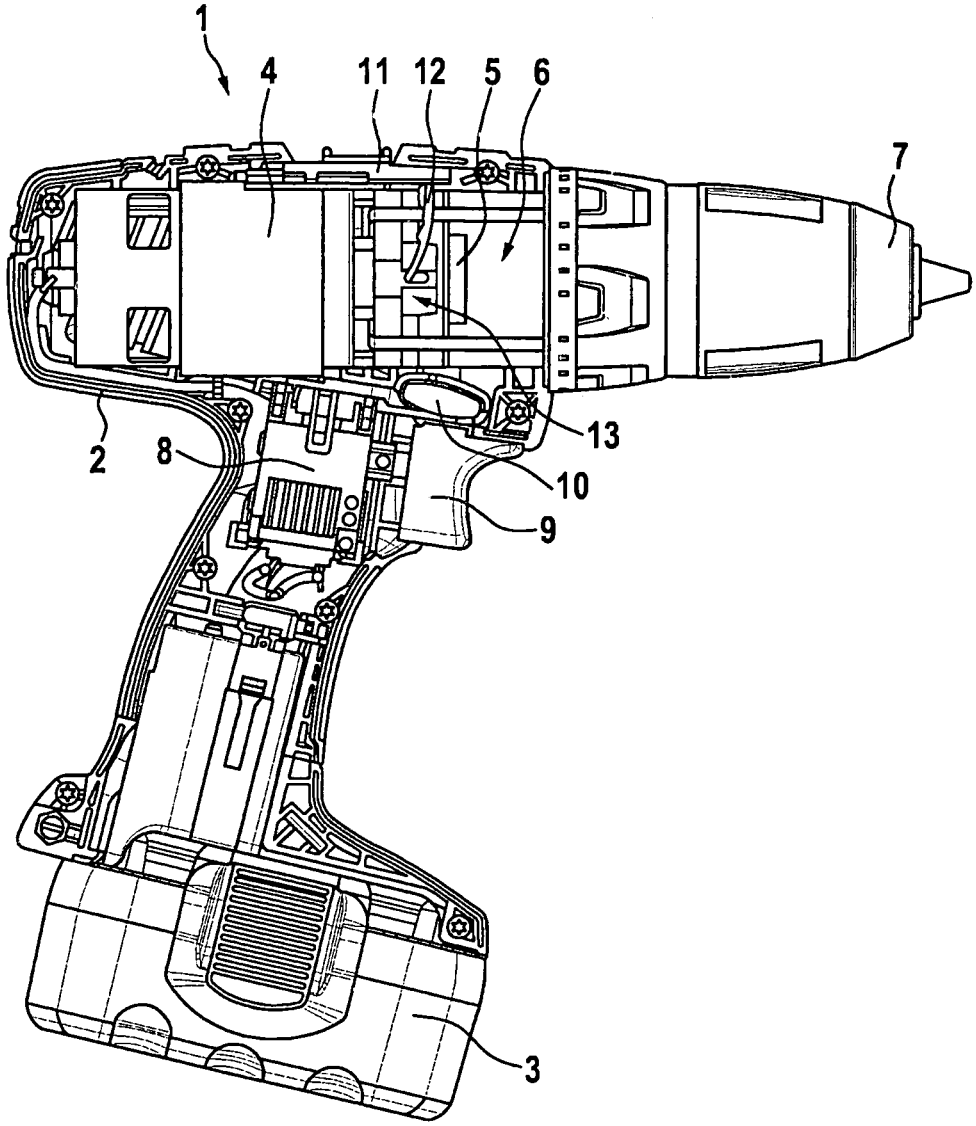
FIG. 1 shows a hand-held tool machine, implemented as rechargeable screwdriver or rechargeable drill, whose gear is adjustable between a first and a second gear ratio, an external gear shifter being provided for the switch between the gear ratios, which is connected, via a coupling spring, to a switching element for actuating the gear.

Hand-held tool machine 1 shown in FIG. 1 is implemented as battery-powered screwdriver or battery-powered drill and has a motor housing 2, which simultaneously forms the handle housing; on its underside, a battery pack 3 for the power supply of electrical drive motor 4 is disposed in exchangeable manner. Drive motor 4 drives a planetary gear 6 disposed inside a gear housing 5, which is coupled to a spindle which acts as support of a tool holder 7 for holding a tool. A switch 8 for actuating drive motor 4 is provided in the motor housing, which switch may be actuated by the operator via a switch detent or a switch pusher 9. The direction of rotation of the drive motor is set via a switch 10 for reversing the direction of rotation.

Planetary gear 6 has one gear ratio as a minimum, but it preferably has two or more gear ratios. Two different gear ratios in planetary gear 6 are selectable via a switching device; at a first gear ratio, the drive motor transmits a lower rotational speed with a higher torque to the spindle for holding the tool, and at a second gear ratio, it transmits a higher rotational speed with a lower torque. The switching device for switching between the gear ratios includes a gear shifter 11, implemented in the form of a switch slider, on the outside of gear housing 5, a coupling spring 12, as well as a switching element 13 disposed inside gear housing 5, with the aid of which a gear element is adjustable between different switching positions. The operator is able to reset gear shifter 11 in the axial direction of the drive motor, axially between the two switching positions. The positioning movement of gear shifter 11 is transmitted to switching element 13, which is supported in the interior of the gear housing in axially displaceable manner, via coupling spring 12, which is supported in gear housing 5 in a manner allowing tilting and preferably implemented in the form of spring washer, the positioning movement of switching element 13 acting on the gear component. More specifically, the particular gear component is implemented as internal gear wheel, which is adjustable between a stop position implemented on the housing, and a stop position coupled in rotatably fixed manner to a planetary gear carrier of the planetary gear. Switching element 13 and the internal gear wheel may be implemented as common component.

Figure 2:
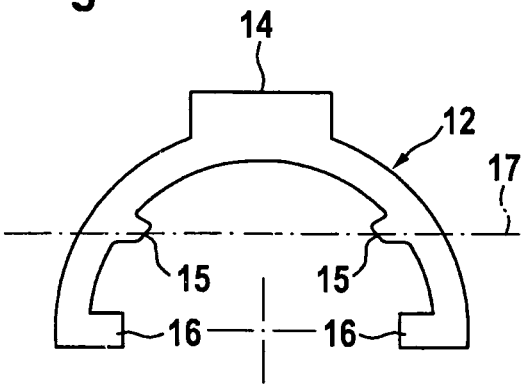
FIG. 2 shows the coupling spring in a semicircular development.

FIG. 2 shows a first exemplary embodiment of a coupling spring. Coupling spring 12 is developed as semicircular spring washer and is made of metal, especially sheet metal. On the radially outer side, in the center of the semicircle, there is an angular driving pin 14, which points radially to the outside and is acted upon by gear shifter 11 in the installed state. Radially inwardly pointing fingers 16 are developed adjacent to the free end faces of the spring washer, which fingers actuate switching element 13 (FIG. 1) in the installed state. Furthermore, approximately in the center between driving pin 14 and fingers 16, lip-shaped tilting elements 15, which point radially toward the inside and via which the spring element is tiltably supported in the gear housing of the hand-held tool machine, are developed on the spring washer. The two lip-shaped tilting elements 15 on the radially inner side lock into place in associated recesses in the housing and define a tilting axis 17, about which coupling spring 12 is tiltable. Tilting axis 17 runs transversely to the longitudinal or motor axis about which the spindle and the tool holder rotate as well.

Driving pin 14, tilting elements 15 as well as fingers 16 are integrally formed with coupling spring 12 in each case.

Fingers 16 radially project further to the inside than tilting elements 15, which allows fingers 16 to exert an elastic effect in the axial direction of the hand-held tool machine, so that fingers 16 assume the function of a spring element in the axial direction, by which switching element 13 (FIG. 1) is acted upon in a springy manner. Fingers 16 are offset by roughly 90° relative to driving pin 14 pointing radially toward the outside; tilting elements 15 on the inside of the spring washer are situated approximately in the middle between driving pin 14 and fingers 16.

In the installed state, coupling spring 12 is prestressed, such that the coupling spring assumes a stable, non-planar position in each of the two switch positions. In the transition between the two switch positions, which represent final positions in each case, coupling spring 12 runs through an unstable position. Once the unstable position has been passed, the coupling spring rebounds to the opposite final position or switching position, which thus is under spring tension.

Figure 3:
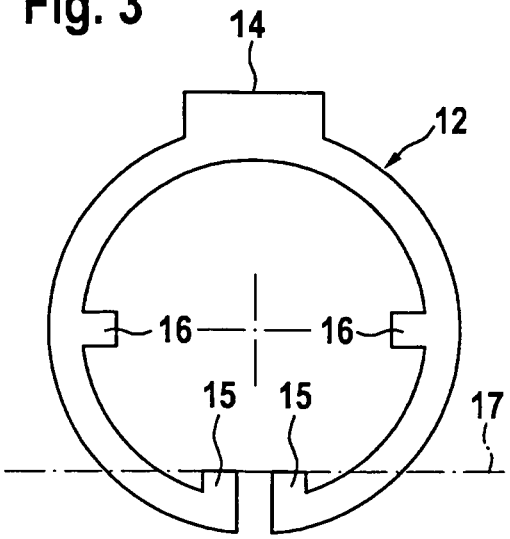
FIG. 3 shows the coupling spring as a full circle.

FIG. 3 shows an additional exemplary embodiment of a coupling spring 12. Coupling spring 12 is implemented as full circle, and radially outwardly projecting driving pin 14 is situated diametrically opposite the lip-shaped tilting elements 15, which project radially to the inside. The two fingers 16 likewise project radially to the inside; they are disposed at an angular offset of 90° both with respect to driving pin 14 and the two tilting elements 15. The two tilting elements 15, which define tilting axle 17, lie directly next to each other in a perforated area of the spring washer. Tilting axle 17 runs approximately tangentially to the inner side of the spring washer. In the installed state, coupling spring 12 is prestressed in that tilting elements 15 are made to overlap.

What is claimed is:

1. A hand-held tool machine, comprising:

a switchable mechanism having at least a first operating position and a second operating position;

an adjustable switching element;

a coupling element implemented as a bistable coupling spring; and an operating element coupled to the adjustable switching element via the coupling element, wherein the adjustable switching element is configured to act on at least one mechanical component of the switchable mechanism such that the switchable mechanism is adjusted between the first operating position and the second operating position in response to a positioning movement of the operating element;

wherein the bistable coupling spring is configured to assume a stable position in a first switching position and a second switching position of the operating element, and assume an unstable position in an intermediate position between the first and second switching positions of the operating element, wherein the bistable coupling spring is implemented as a spring washer and is positioned in the hand-held tool machine under prestressing, wherein elements, which at least one of tilt and pivot, are formed integrally with the spring washer to define an axis running substantially perpendicular to a longitudinal axis of the hand-held tool machine, and wherein the spring washer assumes a non-planar form under pre-stressing in the first and second switching position.

2. The hand-held tool machine as recited in claim 1, wherein the spring washer has a semicircular shape.

3. The hand-held tool machine as recited in claim 1, wherein the spring washer is configured as a full circle.

4. The hand-held tool machine as recited in claim 3, wherein the spring washer has an opening and two free ends arranged next to one another and next to the opening, wherein one element is arranged at each of the two free ends.

5. The hand-held tool machine as recited claim 1, wherein the spring washer has a connecting element projecting radially to the outside and in contact with the operating element.

6. The hand-held tool machine as recited in claim 5, wherein the spring washer has at least one finger projecting radially to the inside and in contact with the switching element.

7. The hand-held tool machine as recited in claim 6, wherein the spring washer has two diametrically opposed fingers.

8. The hand-held tool machine as recited in claim 6, wherein the connecting element and the at least one finger are mutually offset at an angle of 90°.

9. The hand-held tool machine as recited in claim 1, further comprising:

a housing, wherein the spring washer is tiltably or pivotally supported on the housing via the elements.

10. The hand-held tool machine as recited in claim 9, wherein the housing is a gear housing.

11. The hand-held tool machine as recited in claim 9, wherein the spring washer is positioned on the housing under prestressing.

12. The hand-held tool machine as recited in claim 1, wherein the switchable mechanism is configured as a gear.

13. The hand-held tool machine as recited in claim 12, wherein the gear is implemented as a planetary gear.

14. The hand-held tool machine as recited in claim 13, wherein the gear is switchable between at least two gear ratios, and wherein a selected gear ratio of the gear represents an operating position.

15. The hand-held tool machine as recited in claim 14, wherein the operating element is a gear shifter, and wherein a selected gear ratio of the gear is engaged via the gear shifter.

16. The hand-held tool machine as recited in claim 1, wherein the adjustable switching element is an internal gear wheel coupled to a planetary gear carrier of the planetary gear in rotation-proof manner in a switching position of the gear shifter.

17. The hand-held tool machine as recited in claim 16, wherein the coupling spring is implemented as a sheet metal component.

18. The hand-held tool machine as recited in claim 1, wherein the elements are formed integrally with the spring washer on a radially inner side of the spring washer.

19. The hand-held tool machine as recited in claim 1, wherein the elements are formed integrally with the spring washer on a radially outer side of the spring washer.

20. The hand-held tool machine as recited in claim 1, wherein the elements are embodied as projections.

21. The hand-held tool machine as recited in claim 1, wherein the elements are embodied as recesses.

22. A hand-held tool machine, comprising:

a switchable mechanism having at least a first operating position and a second operating position;

an adjustable switching element;

a coupling element implemented as a bistable coupling spring; and an operating element coupled to the adjustable switching element via the coupling element, wherein the adjustable switching element is configured to act on at least one mechanical component of the switchable mechanism such that the switchable mechanism is adjusted between the first operating position and the second operating position in response to a positioning movement of the operating element;

wherein the bistable coupling spring is configured to assume a stable position in a first switching position and a second switching position of the operating element, and assume an unstable position in an intermediate position between the first and second switching positions of the operating element, wherein the bistable coupling spring is implemented as a spring washer and is positioned in the hand-held tool machine under prestressing, wherein elements, which at least one of tilt and pivot, are formed integrally with the spring washer to define an axis running substantially perpendicular to a longitudinal axis of the hand-held tool machine, wherein the spring washer is configured as a full circle, and wherein the spring washer assumes substantially conical form under pre-stressing in the first and second switching position.

23. The hand-held tool machine as recited in claim 22, wherein the spring washer has an opening and two free ends arranged next to one another and next to the opening, wherein one element is arranged at each of the two free ends.

* * * * *